United States Patent [19]

Nakamura et al.

[11] 4,242,441

[45] Dec. 30, 1980

[54] COLOR IMAGE FORMING PROCESS

[75] Inventors: Shigeru Nakamura; Isao Shimamura, both of Minami-ashigara, Japan

[73] Assignee: Fuji Photo Film Co., Ltd., Minami-ashigara, Japan

[21] Appl. No.: 16,694

[22] Filed: Feb. 28, 1979

Related U.S. Application Data

[63] Continuation-in-part of Ser. No. 840,459, Oct. 7, 1977, abandoned.

[30] Foreign Application Priority Data

Oct. 12, 1976 [JP] Japan ..... 51-122577

[51] Int. Cl.[3] ..... G03C 7/00

[52] U.S. Cl. ..... 430/390; 430/393; 430/431; 430/462; 430/559; 430/561

[58] Field of Search ..... 96/53, 20, 60, 61 R; 430/393, 431, 462

[56] References Cited

U.S. PATENT DOCUMENTS

| | | | |
|---|---|---|---|
| 2,564,238 | 8/1951 | Sprung | 96/53 |
| 3,259,497 | 7/1966 | Wartburg | 96/53 |
| 3,716,362 | 2/1973 | Meier | 96/53 |

*Primary Examiner*—J. Travis Brown

*Attorney, Agent, or Firm*—Sughrue, Rothwell, Mion, Zinn and Macpeak

[57] ABSTRACT

A color image forming process comprising processing a photographic element having silver image-wise distributed therein in the presence of a specific type of complexing agent, an oxidizing agent which is peroxo acid or salt thereof, and a dye or dyes, to oxidatively bleach the dye or dyes. By the process of this invention, color images which are stable to light, heat and moisture are obtained using photosensitive materials containing a reduced amount of silver salt or silver without using chemicals causing pollution problems for the processing.

12 Claims, 2 Drawing Figures

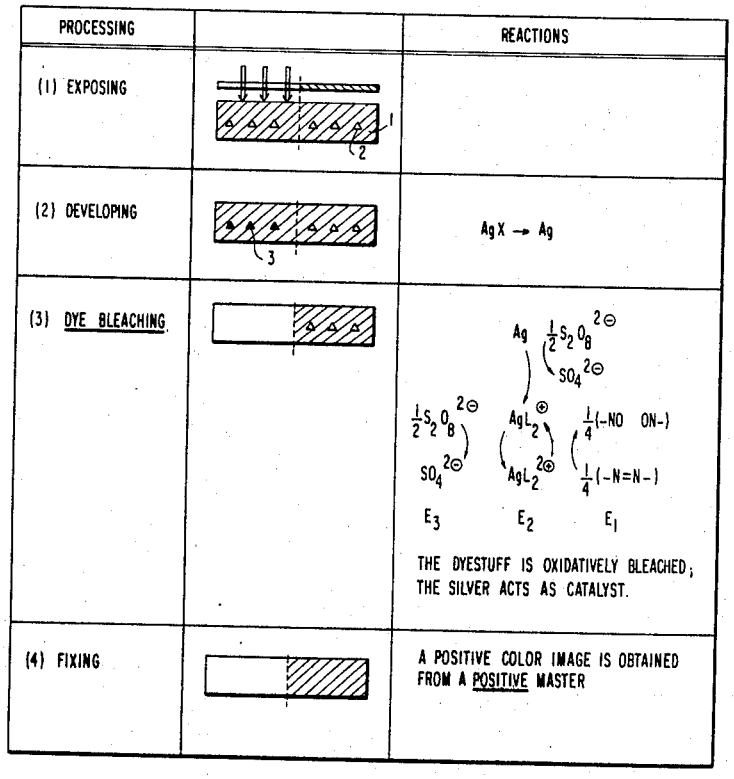

NOTE:
1_ DYESTUFF
2_ PHOTOSENSITIVE SILVER HALIDE GRAIN
3_ DEVELOPED SILVER
L_ COMPLEXING AGENT
X_ HALOGEN

FIG. 1 (THIS INVENTION)

| PROCESSING | | REACTIONS |
|---|---|---|
| (1) EXPOSING | 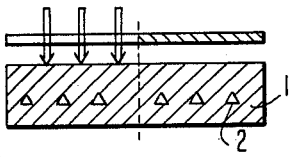  | |
| (2) DEVELOPING | 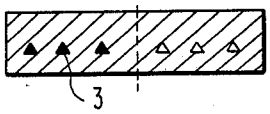  | $AgX \rightarrow Ag$ |
| (3) DYE BLEACHING | 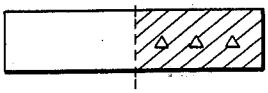 | $Ag$ $\frac{1}{2}S_2O_8^{2\ominus}$ $SO_4^{2\ominus}$<br>$\frac{1}{2}S_2O_8^{2\ominus}$ $SO_4^{2\ominus}$ $AgL_2^{\oplus}$ $AgL_2^{2\oplus}$ $\frac{1}{4}(-NO\ \ ON-)$ $\frac{1}{4}(-N=N-)$<br>$E_3$ $E_2$ $E_1$<br>THE DYESTUFF IS OXIDATIVELY BLEACHED; THE SILVER ACTS AS CATALYST. |
| (4) FIXING | 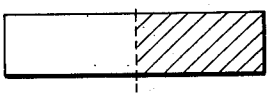 | A POSITIVE COLOR IMAGE IS OBTAINED FROM A POSITIVE MASTER |

NOTE:
1_ DYESTUFF
2_ PHOTOSENSITIVE SILVER HALIDE GRAIN
3_ DEVELOPED SILVER
L_ COMPLEXING AGENT
X_ HALOGEN

FIG. 2

| PROCESSING | | REACTIONS |
|---|---|---|
| (1) EXPOSING | 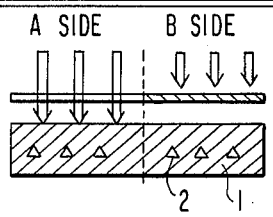 | |
| (2) DEVELOPING | 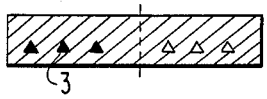 | AT A SIDE ONLY :<br>$AgBr \rightarrow Ag^{o}$ |
| (3) SILVER BLEACHING | 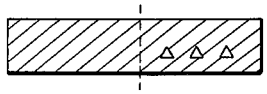 | AT A SIDE ONLY :<br>$Ag^{o} \rightarrow Ag^{\oplus}L_2$ (REMOVED)<br>THE DYESTUFF IS NOT ATTACKED.<br>(COLUMN 4, LINES 32-33) |
| (4) REVERSAL DEVELOPING | 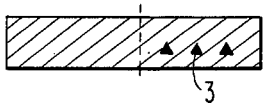 | AT B SIDE :<br>$AgBr \rightarrow Ag^{o}$ |
| (5) DYE BLEACHING | 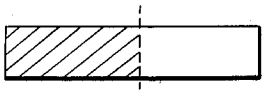 | $Ag^{o}$ $AgL^{\oplus}$ A $AH_2$ $-NH_2$ $H_2N-$ $-N=N-$ |
| (6) FIXING | 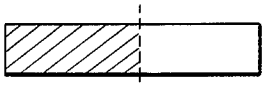 | A POSITIVE COLOR IMAGE FROM A NEGATIVE MASTER.<br>(COLUMN 4, LINES 15-16) |

NOTE:
1_DYESTUFF
2_PHOTOSENSITIVE SILVER HALIDE GRAIN
3_DEVELOPED SILVER
A_CATALYST

COLOR IMAGE FORMING PROCESS

CROSS REFERENCE TO RELATED APPLICATION

This application is a continuation-in-part of U.S. Patent Application Ser. No. 840,459, filed Oct. 7, 1977 by Nakamura et al and entitled Color Image Forming Process, now abandoned.

BACKGROUND OF THE INVENTION

1. Field of the Invention

This invention relates to a color image forming process. More particularly, the invention relates to a color image forming process which comprises processing a photographic element containing silver image-wise distributed therein in the presence of a complexing agent, an oxidizing agent and a dye or dyes, to oxidatively bleach the dye or dyes.

2. Description of the Prior Art

In a general process of forming color images, azomethine dyes or indoaniline dyes are formed by developing silver halide light-sensitive material in the presence of couplers using a primary aromatic amine developing agent. The color development system using silver halide is based on the process invented by L. D. Mannes and L. Godowosky in 1935. Various improvements have been made in the process since then, and the system has usually been employed worldwide in the photographic art.

The color development system using a primary aromatic amine developing agent generally has the following disadvantages. That is, (1) the dyes formed by the system have poor light resistance, heat resistance, and moisture resistance and, hence, the color images formed show a great tendency toward fading with the passage of time, (2) a primary aromatic amine developing agent is toxic to the human body, for example, causing a poisoning of the skin and, thus, specific precautions are required in using this type of developing agent, and (3) since there is an equivalent relationship between the dye image and the oxidation product of the color developing agent, it is theoretically difficult to reduce the amount of the silver halide which takes part in the dye formation to an amount lower than the stoichiometrically required amount.

Conventional techniques of reducing the amount of silver halide in color photography can be classified into reducing the amount of silver halide present over the stoichiometrically required amount thereof as low as possible and reducing the stoichiometrically required amount of silver halide itself. In regard to the latter case, the so-called two equivalent couplers capable of forming one molecule of dye with two molecules of silver halide have been developed. However, even using this technique thus developed, it is theoretically difficult to reduce the amount of silver salt in the light-sensitive materials to less than ½ of the amount of silver salt in light-sensitive materials containing couplers other than two equivalent couplers.

A color photographic process other than the above-mentioned processes employed at present is based on a silver-dye-bleach photographic process. This process is also based on the color photographic process disclosed in U.S. Pat. No. 2,270,118 and, since azo dyes are used in the color process, the color images formed by the process generally have excellent light resistance, heat resistance and moisture resistance.

A typical photographic element used for the silver-dye-bleach color photographic has three silver halide photographic emulsion layers respectively sensitized to red, green, and blue light, and having associated therewith, respectively, a bleachable cyan, magenta and yellow dye. Such a photographic element provides color photographic positive images through the following processing:

(1) The photographic element is image-wise exposed.

(2) The exposed photographic element is developed in a silver halide developer to form negative silver images, the photographic element is then processed in a dye bleach bath which oxidizes the silver images to a silver salt and concurrently decolorizes the associated dye pattern, and, finally the photographic element is fixed and washed to remove the residual silver salt, whereby dye images are obtained which are photographically the reverse of the initial silver images. The silver-dye-bleach process is generally described in, for example, U.S. Pat. Nos. 3,498,787 and 3,503,741, Canadian Pat. No. 790,533 and A. Meyer, "Some Features of the Silver-Dye Bleach Process", *The Journal of Photographic Science,* Vol. 13, 90–97 (1965).

In the silver dye bleach process as described in U.S. Pat. No. 2,270,118, dye images are formed by processing dye-containing layers having silver images with an acid solution which decomposes the dyes at the silver-containing areas. The decomposition or destruction of the dye is accelerated by various "catalysts" such as phenazine. Also, the reaction in these dye bleach systems is considered to proceed on a stoichiometric basis (for example, it is suggested that 4 atoms of silver are required for decomposing one azo dye group in Column 1, lines 18–21 of U.S. Pat. No. 3,340,060).

However, these silver dye bleach processes have the following disadvantages:

(1) Since a large amount of silver is required for bleaching the dyes, the photosensitive materials must contain a large amount of silver halide in the silver halide photographic emulsion layers.

(2) Since a strongly acidic processing solution which is highly corrosive is usually used in these processes, difficulties are encountered in preserving and handling the solution.

Recently, numerous investigations have been made for saving silver as a resource, increasing the efficiency of the reaction system, and improving the quality of the color images formed by reducing the amount of silver required to decompose each molecule of dye.

Several patents are known which deal with various types of image forming processes, for example, U.S. Pat. No. 3,716,362 Meier, U.S. Pat. No. 3,259,497 Wartburg and U.S. Pat. No. 2,564,238 Sprung. These patents are discussed below and compared to the present invention, disclosure relative to the present invention not being part of the prior art, of course, but being offered to offer a valid comparison to the prior art. Reference should also be made to later discussed FIG. 2 for a complete understanding of the subject matter involved.

Turning to U.S. Pat. No. 3,716,362, this patent teaches a process at column 1 lines 64 to 65 wherein metallic silver is removed from a photographic maerial without decomposition of a dye. That is, the reaction of $Ag^{\circ} \rightarrow Ag + L_2$ occurs in this process as shown in FIG. 2. Further, the reaction of Meier involves materials which exhibit the following relationship between their complex forming constant and oxidation-reduction potential:

$$E^{\circ}(AgL_2^{\oplus}+e^{\ominus} \rightleftharpoons Ag^{\circ}+2L) = E^{\circ}(Ag^{\oplus} \rightleftharpoons Ag^{\circ}) - \frac{RT}{F}\ln K_1$$

where R, F and T denote gas constant, Faraday constant and temperature respectively.

When a complexing agent is present, $E^{\circ}(Ag^{+} \rightarrow Ag^{\circ})$ is constant and, therefore, the oxidation-reduction potential of Ag can be represented by the complex forming constant $K_1$.

On the other hand, the present invention teaches a process in which a dye is decomposed at the areas where silver is present, i.e., metallic silver is oxidized by a peroxo sulfate into the Ag(I) complex and the Ag(I) complex is further oxidized by the peroxo sulfate into the Ag(II) complex. In the reaction the complexing agent acts to reduce the oxidation-reduction potential of silver (i.e., $Ag^{\oplus} \rightarrow Ag^{2\oplus}$); thus, this process can be schematically illustrated as follows:

$$E^{\circ}(Ag^{2\oplus} L_2 + e^{\ominus} \rightleftharpoons Ag^{\oplus} L_2) = E^{\circ}(Ag^{2\oplus} \rightleftharpoons Ag^{\oplus}) - \frac{RT}{F}\log\frac{K_2}{K_1}$$

where $K_2$ represents the complex forming constant with $Ag^{2\oplus}$, and $K_1$ represents the complex forming constant with $Ag^{\oplus}$. As is apparent from the above schematic, the complex forming constants directly influence the reaction in the form $K_1/K_2$ and, therefore, E° cannot be expressed by $K_1$ as in Meier. Thus, in the present invention $E^{\circ}(Ag^{2\oplus}L_2+e^{\ominus} \rightleftarrows Ag^{\oplus}L_2)$ is used to define the complexing agent.

The process of this invention differs from the process of Meier as follows.

Meier's process:

Exposure ⟶ Developing ⟶

[Metallic Silver Removing]* ⟶ Reversal Developing ⟶

Dye Bleaching ⟶ Silver Bleaching ⟶ Fixing

*Dye bleaching does not occur in a Metallic Silver Removing bath, i.e., this processing merely removes metallic silver.

The Process of This Invention

Exposure ⟶ Developing ⟶

[Dye Bleaching]** ⟶ Fixing (or Blix)

**Oxidation of silver and dye bleaching occur simultaneously in the Dye Bleaching bath.

In addition, the process of this invention provides a posi-posi image, while the process of Meier provides a nega-posi image, i.e., the process of this invention provides the same image as the master while the process of Meier provides a reversed image to the master.

Further, in Meier an acid bath is used which has the following composition:

Oxidant: Cu(II) salts, quinones or Fe(III) salts

[E° of the oxidant is within the range of +0.15 to +0.8 volt, preferably +0.4 to +0.8 volt]

(Meier, column 2 lines 8 to 12)

Complexing Agent: nitrils, heterocyclic amines or thioethers (Meier, column 2 lines 34 to 36)

pH: below 6

(Meier, column 3 line 41)

The dye bleaching bath of this invention has the following compositions:

Oxidizing Agent: peroxo acid or a salt thereof

Complexing Agent: heterocyclic amine pH: 1 to 7.

Thus, while the complexing agent and pH used in this invention overlap with Meier, the oxidizing agent used in the dye bleaching bath of this invention is quite different from the oxidant used in the acid bath of Meier. The oxidant of Meier has only a weak oxidizing ability to metallic silver (i.e., the E° of Maier's oxidant is preferably +0.4 volt to +0.8 volt) and, therefore, metallic silver can be oxidized into Ag(I) but cannot be oxidized into Ag(II) by the oxidant. The oxidizing agent of this invention has a very strong oxidizing ability to metallic silver (for example, the E° of peroxodisulfuric acid is 2.01 volt) and, therefore, metallic silver can be oxidized into Ag(II) and the dye can be oxidatively decomposed by the resulting ag(II).

U.S. Pat. No. 3,259,497 Wartburg is directed to the same silver-dye-bleach nega-posi process as Meier, and teaches at column 1 lines 56 to 60 that silver bleaching can be carried out without dye decomposition. In the process of this invention, dye is oxidatively bleached in the presence of silver. Thus, the process of this invention is quite different from the process of Wartburg.

U.S. Pat. No. 2,564,238 Sprung teaches at column 1 lines 13 to 18 that dye is reductively decomposed by metallic silver. In the process of this invention, dye is oxidatively decomposed by a oxidizing agent using silver as a catalyst to obtain an image, i.e., the dye bleaching solutions of this invention contain a strong oxidizing agent. Therefore, the process of this invention is quite different from that of Sprung.

SUMMARY OF THE INVENTION

An object of this invention is, therefore, to provide a process of forming color images having excellent light resistance, heat resistance and moisture resistance using light-sensitive materials containing a reduced amount of silver salt or silver.

Another object of this invention is to provide a process of forming color images having excellent light resistance, heat resistance and moisture resistance without using chemicals causing pollution problems.

Still another object of this invention is to provide a process of forming color images which are stable to light, heat and moisture using a processing solution which is less corrosive.

These objects of this invention are attained by a process of forming color images which comprises processing an image-wise exposed and developed photographic element having developed silver image-wise distributed therein in the presence of a specific complexing agent, a peroxo acid or a salt thereof and a dye, which meet the relationship $$E_3 > E_2 > E_1 \quad (1)$$

wherein $E_1$ represents potential necessary to cause oxidative bleaching reaction of the dye, $E_2$ represents the oxidation-reduction potential of the Ag(I)/Ag(II) pair in the presence of the complexing agent, and $E_3$ represents the reduction potential of the peroxo acid or salt thereof, to thereby oxidatively bleach the dye at the areas where the developed silver is present.

BRIEF DESCRIPTION OF THE DRAWINGS

FIG. 1 is a schematic representation of processing steps and reactions which occur in the present invention.

FIG. 2 is a schematic representation of a conventional silver dye bleaching process.

DETAILED DESCRIPTION OF THE INVENTION

In one preferred embodiment of this invention, a photographic element having a silver halide emulsion and a dye is image-wise exposed and developed, whereby image-wise distributed developed silver is produced in the photographic element. Then, the resulting photographic element is processed with a dye bleaching bath containing a peroxo acid or a salt thereof and a complexing agent, whereby the dye is oxidatively bleached at areas where developed silver is present to provide color positive images as shown in FIG. 1.

In the dye bleaching bath of this invention (see FIG. 1), developed silver (i.e., Ag) in the photographic element is oxidized into a monovalent silver complex (i.e., $AgL_2\oplus$, wherein L represents the complexing agent) by the peroxo acid or a salt thereof in the presence of the complexing agent; the resulting monovalent silver complex is further reacted with the peroxo acid or a salt thereof to produce a divalent silver complex having high capability to oxidize the dye (i.e., $AgL_2{}^{2\oplus}$) and an oxo acid radical. The resulting divalent silver complex oxidatively decomposes the dye and, simultaneously, the divalent silver complex itself is reduced back to a monovalent silver complex. The resulting monovalent silver complex is again reacted with the peroxo acid or a salt thereof to produce the divalent silver complex and the oxo acid radical. Thus, the silver itself acts as a catalyst, and, hence, color positive images can be obtained with a very small amount of silver.

Silver ions present in a silver halide cannot be oxidized into the divalent silver complex form mentioned above by the peroxo acid or a salt thereof because the silver ion is halogenized. Thus, this invention is based on a principle which is quite different from that of conventional image forming processes.

The complexing agent employed in this invention can strongly form a complex with a silver diavlent ion, which makes oxidation of the silver monovalent complex into the silver divalent complex easy. The silver divalent complex produced must have a sufficient ability to oxidize the dye, that is, the complexing agent, the peroxo acid or a salt thereof and the dye employed in this invention must meet the relationship $$E_3 > E_2 > E_1 \quad (1)$$

wherein $E_1$ represents the potential causing the oxidative bleaching reaction of the dye, $E_2$ represents the oxidation-reduction potential of the Ag(I)/Ag(II) pair in the presence of the complexing agent, and $E_3$ represents the reduction potential of the peroxo acid or salt thereof.

Useful complexing agents capable of forming a silver divalent complex are given in *Die Grundlagen der Photographischen Prozesse mit Silberhalogeniden Akademische Verlagsgesellshaft* (1968). For example, dipyridyl and picolonic acid can form a silver divalent complex, as follows:

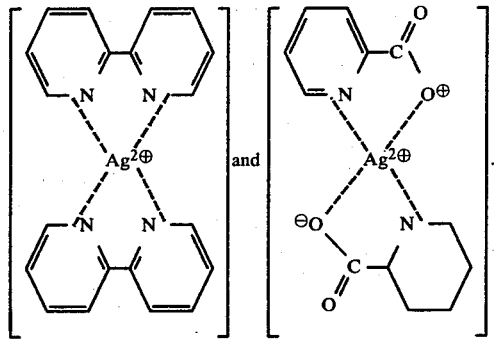

Silver-dye-bleach photographic processes (e.g., the Gaspar color process) are known as conventional processes for forming an image by the bleaching of a dye; however, the process of this invention is quite different from conventional silver-dye-bleach photographic processes as explained above.

FIG. 2 illustrates a negative-positive process of the conventional silver-dye-bleach type as described in U.S. Pat. No. 3,716,362 to Meier. According to the Meier process, after a photographic material is exposed (process step (1) in FIG. 2) and black-and-white developed (process step (2) in FIG. 2), the photographic material is processed with an acid bath (i.e., a silver bleaching bath) containing an oxidant and a complexing agent, whereby developed silver in the photographic material is converted to a soluble silver complex and the soluble silver complex is removed from the photographic material (process step (3) in FIG. 2). In process step (3), dye present in the photographic material must not be decomposed so that a weak oxidant which cannot oxidize the dye and a complexing agent for monovalent silver ion are used in the acid bath.

The photographic material is thus again black-and-white developed (process step (4) in FIG. 2), whereby silver halide remaining in the photographic material is reduced to silver and a photographic material containing uniformly distributed dye and an image-wise distributed developed silver is obtained.

The resulting photographic material is then treated with a processing solution (i.e., the dye bleaching bath in FIG. 2) containing an acid, a complexing agent for silver monovalent ion and a catalyst such as phenzaine, whereby the dye in the photographic material is bleached.

The mechanism of this bleaching reaction is described in Mason, *Photographic Processing Chemistry*, The Focal Press (1975). According to Mason, the silver acts as a reducing agent for the catalyst such as phenazine (i.e., the catalyst is reduced by the silver) and azo dye at silver-containing areas is reduction-bleached by the reduced catalyst. The bleaching in this mechanism is a reduction-bleaching and an amount of silver equivalent to that of the azo dye must be used and any silver monovalent complex produced is not re-utilized.

According to the process of this invention, silver acts as a catalyst for the oxidation reaction of the dye or dyes by the oxidizing agent and hence the amount of silver employed in the photographic element can be greatly reduced. That is, in the process of this invention, the bleaching of the dye can be sufficiently performed with the amount of silver of less than about 1/5 of the amount of silver required in the conventional silver dye bleach process.

A general photographic material contains about 3 to about 10 g/m$^2$ of silver salt as silver and a photographic printing material contains about 1 to about 4 g/m$^2$ of silver but the coated amount of silver in the photographic material of this invention is less than about 3 g/m$^2$, in particular, less than 2 g/m$^2$. Also, in the case of a multilayer photographic material used in this invention, the coated amount of silver per silver halide emulsion layer is less than about 1 g/m$^2$, in particular, 0.5 g/m$^2$ to 1 mg/m$^2$.

According to an embodiment of this invention, color images are formed by processing a photographic light-sensitive material having silver image-wise distributed therein in the presence of a complexing agent, an oxidizing agent and a dye or dyes to oxidatively bleach the dye or dyes.

In another embodiment of this invention, color images are obtained using a direct positive silver halide emulsion as the silver halide emulsion in the above-described embodiment of the process of this invention.

In still another embodiment of this invention, color positive images are obtained by image-wise exposing a photographic element having at least one silver halide emulsion layer followed by development, then immersing the photographic element in a dye-containing bath to dye the photographic element with the dye in the bath, and then immersing the photographic element in a bath containing an oxidizing agent and a complexing agent to bleach the dye.

In another embodiment of this invention, color positive images are obtained by image-wise exposing a photographic element having at least one silver halide emulsion layer and, associated therewith, a dye and a complexing agent, followed by development to form an image pattern of developed silver and then immersing the photographic element in a bath containing an oxidizing agent to bleach the dye at the silver image-containing area.

In a further embodiment of this invention, a photographic element having at least one photosensitive layer containing silver halide and a layer containing a dye, a complexing agent and an oxidizing agent is image-wise exposed and developed by spreading thereover a viscous processing solution containing a color developing agent and a silver halide solvent, whereby the undeveloped silver halide is dissolved by the silver halide solvent, the silver ions formed are diffused into the dye-containing layer to bleach the dye there in an image-like pattern. In the process, the dye, complexing agent and oxidizing agent may be incorporated in separate layers or alternatively a part of these additives may be incorporated in the processing solution. Furthermore, in the process, by associating the dyes and the silver halide emulsion layers, the photographic element may have a three-layer structure of a red-sensitive layer, a green-sensitive layer and a blue-sensitive layer. Still further, a subsidiary layer or layers may be included in the photographic element.

In another embodiment of this invention, a print-out silver image formed by image-wise exposing a silver salt light-sensitive material is utilized. The light-sensitive material of this kind can be a photographic material containing a known halogen-acceptor for accelerating the printing-out effect and a photographic material containing a silver salt capable of being easily thermally decomposed, such as a silver salt of a fatty acid. In the process of this invention, a print-out silver image is formed by exposing a photographic element containing such a silver salt and a dye and then the photographic element is immersed in a bath containing an oxidizing agent and a complexing agent, whereby the dye is bleached at the area containing the print-out silver image to provide a color positive image.

A wide variety of compounds can be used as the oxidizing agent so long as they are selected from peroxo acids and the salts thereof used in this invention which satisfy the oxidation reduction conditions shown by relationship (1) described above to the silver potential in the presence of a complexing agent.

A peroxo acid is an acid having the structure of an oxyacid in which a peroxo group (—O—O— group) is present in place of an oxygen atom. Also, a peroxo acid is an acid prepared from hydrogen peroxide and an oxyacid or an acid which forms hydrogen peroxide by the reaction with sulfuric acid.

Specific examples of suitable peroxo acids are peroxonitric acid, peroxocarbonic acid, peroxodisulfuric acid (persulfuric acid), peroxoboric acid, peroxophosphoric acid, peroxotungstic acid, peroxotitanic acid, etc. Suitable peroxo acid salts which can be used in this invention are the alkali metal salts (lithium salts, sodium salts, potassium salts, etc.) of peroxo acids, alkaline earth metal salts (magnesium salts, calcium salts, etc.) of peroxo acids, and ammonium salts of peroxo acids.

The most preferred examples of the oxidizing agents used in this invention are persulfates such as potassium persulfate, sodium persulfate, ammonium persulfate, etc.

The complexing agent used in this invention is a material which exhibits an oxidation reduction potential of Ag(I)/Ag(II) in the range (with respect to the normal hydrogen electrode) of about 1.9 volts to about 1.1 volts, preferably 1.7 volts to 1.3 volts. Complexing agents satisfying the above-described condition include heterocyclic compounds having at least one nitrogen atom (pyridine type nitrogen atom). Preferred examples of heterocyclic compounds are nitrogen-containing heterocyclic compounds having a covalent double bond. The nuclei of these heterocyclic compounds can be any desired nuclei as described in Arien Albert, "π-Lack-N-Heteroaromatic Compound", *Heterocyclic Chemistry, An Introduction,* Chapter 4, The Athlone Press, 1959.

The most preferred heterocyclic compounds have the following general formula (I):

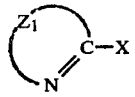

(I)

wherein $Z_1$ represents the atoms (carbon, nitrogen or oxygen) necessary for forming a 5-membered or 6-membered heterocyclic ring, in which the 5-membered or 6-membered heterocyclic ring may have one or more substituents or may form one or more condensed rings (for example, aromatic rings such as a benzene ring, a naphthalene ring, etc., and nitrogen-containing heterocyclic rings such as a 1,5-naphthalidine ring, a pteridine ring, etc.), such as a quinoline ring, a phenanthroline ring, an indole ring, a phenanthridine ring, etc. Furthermore, the condensed ring may also be substituted with one or more substituents. In this case, however, the substituents bonded to the 5-membered ring or the 6-membered ring and also to the condensed ring do not include groups containing sulfur and selenium, such as —SH, SeH, =S, =Se. A suitable example of such a substituent is a lower alkyl group having 1 to 5 carbon atoms (for example, a methyl group). X in the above formula represents —COOM, —OH, —$SO_3M$ (wherein M represents H, Li, Na, K or $NH_4$), —CH=NOH, or a heterocyclic ring containing one or more nitrogen atoms, e.g., such as a pyridine ring, a pyrrole ring, a quinoline ring, a phenanthroline ring, etc., in which the heterocyclic ring may have one or more substituents or may form a condensed ring. A suitable example of such a substituent is a lower alkyl group having 1 to 5 carbon atoms (for example, a methyl group). Also, the condensed ring may further be substituted with one or more substituents. In this case, also, these substituents do not include groups containing sulfur or selenium, such as —SH, —SeH, =S, =Se, etc.

Specific examples of suitable heterocyclic ring nuclei for $Z_1$ and X are pyridine, quinoline, acridine, isoquinoline, phenanthridine, pyridazine, pyrimidine, pyrazine, triazine, quinazoline, 1,5-naphthyridine, pteridine, indole, phenanthroline, etc., nuclei.

Particularly preferred complexing agents are represented by the following general formula (II):

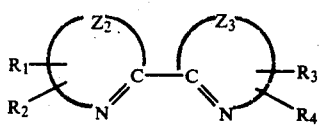

(II)

wherein $Z_2$ and $Z_3$, which may be the same or different, each represents the atoms (carbon, nitrogen or oxygen) for forming a 5-membered or 6-membered heterocyclic ring, in which the 5-membered or 6-membered ring may form one or more condensed rings such as aromatic rings (e.g., a benzene ring, a naphthalene ring, etc.) and nitrogen-containing heterocyclic rings (e.g., a 1,5-naphthyridine, etc.) such as a pyridine ring, a pyrrole ring, a quinoline ring, a phenanthridine ring, an indole ring, a phenanthridine ring, etc.; and $R_1$, $R_2$, $R_3$ and $R_4$, which may be the same or different, each represents a hydrogen atom, a lower alkyl group having 1 to 5 carbon atoms, —$SO_3M$, or —COOM (wherein M represents H, Li, Na, K or $NH_4$).

Specific examples of particularly preferred complexing agents are α,α'-dipyridyl, o-phenanthroline, 4,7-diphenyl-1,10-phenanthrolinesulfonic acid, 4,7-diphenyl-2,9-dimethyl-1,10-phenanthrolinesulfonic acid, 2-methyl-1,10-phenanthroline, 5-methyl-1,10-phenanthroline, 2,9-dimethyl-1,10-phenanthroline, 4,7-dimethyl-1,10-phenanthroline, 5-phenyl-1,10-phenanthroline, α-picolinic acid, etc.

As explained above, the dye bleaching bath used in the process of this invention contains an oxidizing agent and a complexing agent and, therefore, the dye bleaching bath of this invention appears to resemble a silver bleach fixing bath as is used in a conventional color development system or a silver-dye-bleaching process. However, the dye bleaching bath of this invention is quite different from a silver bleach fixing bath as used in conventional processing, as follows.

The process of this invention was attained by the specific combination of an oxidizing agent and a complexing agent, i.e., the combination of a peroxo acid or salt thereof and a complexing agent capable of strongly forming a complex with Ag(II).

The peroxo acid or salt thereof has a strong oxidizing ability on silver but the reaction rate of the oxidation is very slow. Therefore, if a catalyst exhibiting a suitable oxidation-reduction potential of Ag(I)/Ag(II) is present, the reaction rate of the oxidation reaction can be greatly increased. A silver complex having a standard oxidation-reduction potential of Ag(I)/Ag(II) in the range of about 1.9 to about 1.1 volts is effective as the above catalyst. When the oxidation reduction potential of Ag(I)/Ag(II) is higher than about 1.9 volts, reaction of the peroxo acid or salt thereof with the silver monovalent complex does not substantially occur. On the other hand, when the oxidation reduction potential of Ag(I)/Ag(II) is lower than about 1.1 volts silver can be oxidized into the silver divalent complex by the peroxo acid or salt thereof, but oxidative decomposition of the dye by the silver dilvalent complex does not occur. Therefore, only a silver complex having an oxidation-reduction potential of Ag(I)/Ag(II) in the range of about 1.9 to about 1.1 volts accelerates the oxidative decomposition of the dye.

The specific combination of the oxidizing agent and the complexing agent used in this invention is not suggested by the combination of an oxidizing agent and a complexing agent as used in a conventional silver-bleach-fixing bath. This is because the object of a conventional silver-bleach-fixing bath is to oxidize only metallic silver without decomposing dye, formation of color images being carried out in a distinct bath. The object of this invention is to oxidatively decompose dye in the dye bleaching bath to obtain a color image. Thus, the function of the dye bleaching bath containing the specific oxidizing and complexing agent of the present invention is quite different from that of a conventional silver-bleach-fixing bath and is not suggested thereby.

The dyes used in this invention are oxidatively bleachable dyes and illustrative examples include azo dyes, anthraquinone dyes, etc. Typical examples of these dyes are described in *Color Index,* Vol. 4, 3rd Edition, The Society of Dyers and Colorists. Particularly suitable dyes which can be used in this invention are azo dyes such as monoazo dyes (C.I. 11,000–19,999), bisazo dyes (C.I. 20,000–29,999), trisazo dyes (C.I. 30,000–34,999), and polyazo dyes (C.I. 35,000–36,999); triarylmethane dyes (C.I. 42,000–44,999); acridine dyes (C.I. 46,000–46,999), azine dyes (C.I. 50,000–50,999); thiazine dyes (C.I. 52,000–52,999); and anthraquinone dyes (C.I. 58,000–72,999). (In the descriptions given herein C.I. designates the Color Index number).

Also, the dyes used in the silver-dye-bleach process can all be used in the process of this invention.

Yellow dyes usually used include azo dyes such as Direct Fast Yellow GC (C.I. 29,000), Sirius Supra Yellow R (C.I. 29,025), Chrysophenine (C.I. 24,895), etc.; benzoquinone dyes, anthraquinone dyes, polycyclic soluble vat dyeing dyes, and vat dyeing dyes such as Indigosol Yellow HCGN (C.I. 56,006), Indigosol Golden Yellow IGK (C.I. 59,101), Indigosol Yellow 2 GB (C.I. 61,726), Algosol Yellow GCA-CF (C.I. 67,301), Indigosol Yellow V (C.I. 60,531), Indanthrene Yellow 4GF (C.I. 68,420), Indanthrene Yellow G (C.I. 70,600), Mikethren Yellow GC (C.I. 67,300), Indanthrene Yellow 4GK (C.I. 68,405), etc. Also, magenta dyes used generally include azo dyes such a Nippon Fast Red BB (C.I. 29,100), Siriun Supra Rubbine B (C.I. 25,380), Sumilight Supra Rubinol B (C.I. 29,225), Benzo Brilliant Gelanine B (C.I. 15,080), etc.; phthalocyanine compounds such as Sumilight Supra Turkish Blue G (C.I. 74,180), Mikethren Brilliant Blue 4G (C.I. 74,140), etc.; and also azo dyes and vat dyeing dyes such as Indanthrene Turkish Blue 3 GK (C.I. 67,915), Indanthrene Blue 5G (C.I. 69,845), Indanthrene Blue GCD (C.I. 69,810), Indigosol 04B (C.I. 73,066), Indigosol 04G (C.I. 73,046), Anthrasol Green IB (C.I. 59,826), etc.

Furthermore, the dyes described in U.S. Pat. Nos. 2,286,714, 2,286,837, 2,294,892, 2,294,893, 2,418,624, 2,420,630, 2,420,631, 2,612,448, 2,629,658, 2,705,708, 2,694,636, 3,002,964, 3,114,634 and 3,119,811 can be used in this invention.

The dyes incorporated in the photographic elements used in the process of this invention are bleachable dyes and, preferably are non-diffusible dyes which can be well known in the photographic art. The term "bleachable dye" as used in the specification of this invention includes dye precursors, that is, compounds which color during development of the photographic materials containing such precursors. Also, the term "non-diffusible dye" as used in the specification means a bleachable dye which is non-diffusible in a silver halide emulsion or the dye which becomes non-diffusible by using a suitable mordant, such as, for example, the dyes as described in U.S. Pat. No. 2,882,156.

The photographic element used in this invention may have a single silver halide emulsion layer or coating for obtaining a monochromatic dye image, which may be colored or neutral (for example, a black-and-white image), formed by one kind of dye or a mixture of dyes. Typical useful neutral dyes for such a photographic material are the azo dyes as described in British Pat. No. 999,996.

Also, the photographic element used in this invention may have a plurality of layers and contain a plurality of different bleachable dyes for forming natural or multicolor images. A particularly useful photographic element which can be employed in this invention has at least three silver halide emulsion layers which respectively contain a non-diffusible yellow, magenta and cyan dye and have been sensitized, respectively, to blue, green and red light.

The silver halide emulsion layer used in this invention contains a bleachable dye. However, if desired, the bleachable dye can be incorporated in an alkali-permeable layer adjacent the silver halide emulsion layer and this case is sometimes preferred. With such a configuration, the speed of the color photographic material can be increased or a layer structure composed of a silver halide emulsion layer and a layer containing a bleachable dye, the dye-containing layer being disposed under the silver halide emulsion layer, can be used. An example of such a configuration is a multilayer color photographic element having formed, in succession, on a support the following layers: that is, a blue-sensitive silver halide-containing layer, a bleachable yellow dye-containing layer, a green-sensitive silver halide-containing layer, a bleachable magenta dye-containing layer, a red-sensitive silver halide-containing layer, and a bleachable cyan dye-containing layer.

In an embodiment of this invention, the dyes may be incorporated in a processing bath and the dyes used for the purpose of water-soluble and diffusible dyes. In this case, the diffusible dye dyes the binder and becomes thus non-diffusible. Also, by using an appropriate mordant in the photographic elements, the dye diffused can be rendered non-diffusible.

When the dye is added to a photographic element, a preferred amount of the dye is about $1\times10^{-4}$ to about $1\times10^{-2}$ mol/m$^2$. When the dye is added to a pre-bath or an other processing bath, a preferred amount of the dye is about $1\times10^{-4}$ to about $1\times10^{-1}$ mol/leter.

Appropriate mordants which can be used for this purpose are the polymers described in British Pat. No. 685,475, U.S. Pat. Nos. 2,675,316, 2,839,401, 2,882,156, 3,048,487, 3,184,309 and 3,445,231, West German Patent Application (OLS) No. 1,914,362 and Japanese Patent Application (O)I) Nos. 47,624/75 and 71,332/75.

The photographic material used in this invention contains a silver salt and/or metallic silver. Suitable silver salts are silver halides such as silver chloride, silver bromide, silver iodide, silver chlorobromide, silver iodobromide, and silver chloroiodobromic and silver salts or organic acids such as silver behenate. The metallic silver used in this invention is fine granular metallic silver and a typical example is colloidal silver.

Furthermore, photographic materials of a non-silver salt type such as a zinc oxide photographic materials may be also used as the photographic materials employed in this invention. In this case, an image-wise distribution of silver is obtained by physically developing the photographic material using a silver salt after image-wise exposure. Moreover, the silver nuclei may be formed by utilizing the physical development as described in Dutch patent No. 6,603,640 German patent No. 1,216,685 and U.S. Pat. No. 3,157,502.

In the process of this invention, it is generally preferred for the complexing agent to be incorporated in a dye bleach bath containing an oxidizing agent. The dye bleach bath composition contains one or more oxidizing agents and one or more complexing agents. Moreover, if desired, the dye bleach bath composition may also contain a pH buffering agent such as a phosphate, a carbonate, etc.; a salt such as a sulfate, a perchlorate, a nitrate, etc.; an alkali such as sodium hydroxide, ammonium hydroxide, etc.; and an acid such as sulfuric acid, nitric acid, phosphoric acid, acetic acid, and citric acid.

The proportion of the oxidizing agent in the dye bleach bath is about $1\times10^{-3}$ to about 2 mols/l, preferably $5\times10^{-3}$ to 1 mol/l, more preferably $1\times10^{-2}$ to $5\times10^{-1}$ mol/l. Also, the proportion of the complexing agent in the dye bleach bath is about $1\times10^{-4}$ to about 1 mol/l, preferably $5\times10^{-4}$ to $5\times10^{-1}$ mol/l, more particularly $1\times10^{-3}$ to $1\times10^{-1}$ mol/l. Furthermore, the pH of the dye bleach bath is about 1 to about 12, preferably 2 to 7, and more preferably 2 to 5.

When the complexing agent and the oxidizing agent are present together in the same bath, a preferred molar ratio of complexing agent/oxidizing agent is about 1:10000 to about 1:1. When the complexing agent and the dye are present together in the same photographic element, a preferred molar ratio of dye/complexing agent is about 1:100 to about 100:1.

The developer used for forming an image pattern of developed silver in a photographic element containing silver halide is a developer containing at least one developing agent such as aminophenol (for example, 4-(N-methylamino)-phenol, N,N-diethyl-p-aminophenol, etc.); a 3-pyrazolidone (e.g., 1-phenyl-3-pyrazolidone, 4,4-dimethyl-1-phenyl-3-pyrazolidone, 4-methyl-4-hydroxymethyl-1-phenyl-3-pyrazolidone, 4,4-dihydroxymethyl-1-phenyl-3-pyrazolidone, etc.); a dihydroxybenzene (e.g., hydroquinone, methylhydroquinone, chlorohydroquinone catechol, 4-phenylcatechol, etc.); and ascorbic acid.

The developer may further contain, if desired, the following additives.

For example, alkali agents and buffering agents such as sodium hydroxide, potassium hydroxide, sodium carbonate, potassium carbonate, sodium tertiary phosphate, potassium tertiary phosphate, potassium metaborate, and boric acid can be used individually or as a combination thereof. Also, for the purpose of imparting buffering capability to the developer, improviding the ability of the developer to act as a solvent, and further for increasing the ionic strength of the developer, various salts such as disodium hydrogenphosphate, dipotassium hydrogenphosphate, potassium dihydrogenphosphate, sodium dihydrogenphosphate, sodium hydrogencarbonate, potassium hydrogencarbonate, boric acid, an alkali metal nitrate, an alkali metal sulfate, etc., may be used in the developer.

Furthermore, if desired, the developer used in this invention may contain a development accelerator. Examples of useful development accelerators are the various pyridinium compounds and other cationic compounds as described in U.S. Pat. Nos. 2,648,604 and 3,671,247 and Japanese Patent Publication No. 9503/69; cationic dyes such as phenosafranine; neutral salts such as thallium nitrate and potassium nitrate; polyethylene glycol and the derivatives thereof as described in Japanese Patent Publication No. 9504/96 and U.S. Pat. Nos. 2,533,990, 2,531,832, 2,950,970 and 2,577,127; nonionic compounds such as polythioethers; the organic solvents and organic amines as described in Japanese Patent Publication No. 9509/69 and Belgian Patent. No. 682,862; ethanolamine; ethylenediamine; and also the development accelerators as described in L. F. A. Mason, *Photographic Processing Chemistry,* pages 40–43, Focal Press, London (1966).

Other examples of the useful development accelerators which can be used in this invention are benzyl alcohol and phenylethyl alcohol as described in U.S. Pat. No. 2,515,147, and pyridine, ammonia, hydrazine and the amines as described in *Journal of the Society of Photographic Science and Technology of Japan,* Vol. 14, 74 (1952).

Moreover, sodium sulfite, potassium sulfite, potassium hydrogensulfite, sodium hydrogensulfite, etc., which are usually used as preservatives may be employed in the developer used in this invention.

Also, the developer used in this invention may further contain, if desired, an anti-foggant. Examples of anti-foggants include an alakali metal halide such as potassium bromide, sodium bromide, potassium iodide, etc., as well as organic anti-foggants. Examples of organic anti-foggants are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, etc.; mercapto-substituted heterocyclic compounds such as 1-phenyl-5-mercaptotetrazole, 2-mercaptobenzimidazole, 2-mercaptobenzothiazole, etc.; and mercapto-substituted aromatic compounds such as thiosalicylic acid, etc. The amount of the anti-foggant generally used is about 1 mg to about 5 g, preferably 5 mg to 1 g, per liter of the developer.

Still further, polyphosphoric acid compounds such as sodium hexamethaphosphate, sodium tetrapolyphosphate, sodium tripolyphosphate, potassium hexametaphosphate, potassium tetrapolyphosphate, potassium tripolyphosphate, etc.; and aminopolycarboxylic acids such as phosphonocarboxylic acid, ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, etc., may also be used as a water softener in the developer. The amount of the water softener depends upon the hardness of water used but is usually about 0.5 to about 1 g/l.

Furthermore, a calcium or magnesium sequestering agent may be used in the photographic processing solution as described in detail in J. Willems, *Belgische Chemische Industrie,* Vol. 21, 325 (1956) and ibid., Vol. 23, 1105 (1958).

By adding a silver halide solvent, the developer can be used as a monobath developer-fixer solution. Fixing agents well known in the art can be used as the silver halide solvent. Specific examples of suitable fixing agents are thiosulfates such as sodium thiosulfate, potassium thiosulfate, etc.; thiocyanates such as potassium thiocyanate, sodium thiocyanate, etc.; organic amines such as alkanolamine, etc.; and thioether compounds. A monobath developer-fixer solution is described in, for example, L. F. A. Mason, *Photographic Processing Chemistry,* pages 156–160, Focal Press, London (1966).

The most general color photographic element used in the process of this invention comprises a support having at least one silver halide emulsion ayer thereon but usually the color photographic element used in this invention comprises a support having thereon a red-sensitive silver halide emulsion layer, a green-sensitive silver halide emulsion layer, and a blue-sensitive silver halide emulsion layer. Most generally, the color photographic element used in the invention comprises a support having thereon at least one red-sensitive silver halide emulsion layer containing a cyan dye, at least one green-sensitive silver halide emulsion layer containing a magenta dye, and at least one blue-sensitive silver halide emulsion layer containing a yellow dye. Such a color photographic element may further contain non-photosensitive photographic layers (for example, an antihalation layer, an interlayer for preventing color mixing, a yellow filter layer, a protective layer, etc.). Also, the order of disposition of the red-sensitive layer, green-sensitive layer and blue-sensitive layer is not particularly restricted. Each dye may be present in the layer containing silver halide or may be present in a photographic layer adjacent a silver halide emulsion layer.

The color photographic element processed in the process of this invention may contain in the photographic emulsion layer or layers silver bromide, silver chloride, silver chlorobromide, silver iodobromide or silver iodochlorobromide as the silver halide. When the color photographic element has two or more photographic emulsion layers, a combination of two or more of the silver halides described above may be employed.

The silver halide photographic emulsion may be prepared using the process described in P. Grafkides, *Chimie Photographique,* Paul Montel, Paris (1967) and further the silver halide emulsion may also be prepared using any one of an ammonia method, a neutral method, an acid method, a single jet method, a reverse mixing method, a double jet method, and a controlled double jet method.

The crystal form of the silver halide grains may be a cubic system, an octahedral system, or a mixed crystal system thereof. The silver halide grains used in this invention may be the type having a uniform crystal structure throughout the grain, the type having a layer structure where the property of the surface of the grain is different from the interior of the grain, or be a so-called conversion type as described in British Pat. No. 635,841 and U.S. Pat. No. 3,622,318. Furthermore, the silver halide grains used in this invention may be the type forming a latent image mainly on the surface thereof or may be the type forming a latent image in the interior of the grain.

The silver halide emulsion used in this invention may be chemically sensitive using known methods. For chemical sensitization, the sulfur compounds as described in U.S. Pat. No. 1,574,944, the gold compounds as described in U.S. Pat. No. 2,399,083, the compounds of noble metals such as platinum, palladium, iridium, rhodium, ruthenium, etc., as described in U.S. Pat. Nos. 2,448,060 and 2,598,079 and British Pat. No. 618,061; and reducing agents such as stannous salts and amines may be used.

In the silver halide emulsion layers and other photographic layers of the photographic light-sensitive materials processed by the process of this invention, gelatin is usually used as the hydrophilic colloid but hydrophilic colloids other than gelatin may be used. For example, gelatin derivatives; graft polymers of gelatin and other polymers; cellulose derivatives such as hydroxyethyl cellulose, carboxymethyl cellulose, cellulose sulfate, etc.; saccharide derivatives such as sodium alginate, startch derivatives, etc.; and various other synthetic hydrophilic polymers such as polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole, etc., can be used.

Lime-treated gelatin and acid-treated gelatin can be used as the gelatin and useful gelatin derivatives are the reaction products of gelatin and acid halides, acid anhydrides or isocyanates.

The light-sensitive materials used in this invention may further contain the hardening agents as described in U.S. Pat. No. 3,325,287; the compounds as described in U.S. Pat. No. 3,775,128; plasticizers such as glycerol; alkylbenzene sulfonates; alkylene oxide condensation products; the compounds as described in U.S. Pat. Nos. 2,739,891 and 3,415,649; other surface active agents; and other additives for improving the photographic properties, image characteristics, and mechanical properties of the light-sensitive materials.

The photographic element processed by the process of this invention may contain an ultraviolet absorbent in a hydrophilic colloid layer. Examples of such ultraviolet absorbents are aryl-substituted benzotriazole compounds as described in, for example, U.S. Pat. No. 3,533,794; 4-thiazolidone compounds as described in, for example, U.S. Pat. Nos. 3,314,794 and 3,352,681; benzophenone compounds as described in, for example, Japanese Patent Application (OPI) No. 2,784/71; cinnamic acid esters as described in U.S. Pat. Nos. 3,705,805 and 3,707,375; and benzoxazole compounds as described in, for example, U.S. Pat. No. 3,499,762.

Moreover, the hydrophilic colloid layers of the light-sensitive materials processed by the process of this invention may further contain stilbene series fluorescent brightening agents, triazine series brightening agents, oxazole series brightening agents, or cumarin series brightening agents. They may be water-soluble or water-insoluble and in the latter case, they may be used as dispersions thereof. Suitable examples of these fluorescent brightening agents are described in U.S. Pat. Nos. 2,632,701, 3,269,840 and 3,359,102 and British Pat. No. 1,319,763.

For obtaining a photographic image, the light-sensitive material is first image-wise exposed in an ordinary manner. That is, various light sources such as natural light (sunlight), a tungsten lamp, a fluorescent lamp, a mercury lamp, a xenon arc lamp, a carbon arc lamp, a xenon flash lamp, a cathode ray flying spot, etc., may be employed for the exposure. The exposure time usually ranges from about 1/1,000 second to 1 second as generally used for camera exposure but a shorter exposure time, for example, about $1/10^4$ to about $1/10^6$ second using a xenon flash lamp or a cathode ray flying spot and also an exposure longer than 1 second can be employed in this invention. If desired, the spectral composition of the light used for exposure can be controlled by a color filter. Furthermore, laser light may be used for the exposure. Moreover, the exposure may be performed by the light emitted from a phosphor excited by an electron beam, X-rays, gamma rays, alpha rays, etc.

The process of this invention is superior to conventional processes. Some of the advantages are set forth below.

(1) Color images having excellent light fastness, heat resistance, and moisture resistance as compared with those obtained by conventional color development are obtained.

(2) The amount of silver in the color photographic materials can be greatly reduced as compared with that required for conventional color development, the silver dye bleach method, and the color intensification method.

(3) Since the amount of silver and the amount of polymers such as gelatin in the color photographic materials can be reduced, the thickness of the emulsion layers can be reduced effectively, which results in increasing the sharpness of images obtained.

(4) Chemicals such as p-phenylenediamine derivatives hazardous to the human body, usually used in conventional color development and a strongly acidic processing solution having a strong corrosive activity usually used in a conventional silver dye bleach process are not used in this invention.

(5) As compared with a color intensification process using a cobalt complex and hydrogen peroxide, the process of this invention is simple in terms of processing steps and the stability of the processing solutions used in this invention is high.

The invention is further described more specifically by reference to the following examples but the invention is not to be construed as being limited to the embodiments illustrated in these examples. Unless otherwise indicated herein, all parts, percents, ratios and the like are by weight.

EXAMPLE 1

A photographic element was prepared by coating on a cellulose triacetate support having a subbing layer thereon a silver iodobromide emulsion (silver iodide: 4 mol%; mean grain size: 0.7 micron) containing a cyan dye (coated coverage of 1,612 mg/m$^2$) having the structure shown below:

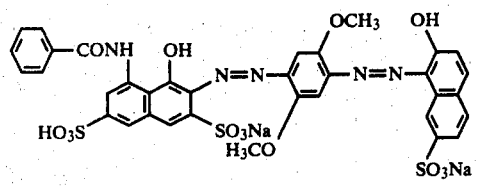

at a coverage of silver of 100 mg/m$^2$ and then coating thereon a gelatin protective layer at a coverage of gelatin of 1,000 mg/m$^2$.

The photographic element was exposed through an optical wedge using an actinometer to a tungsten lamp of a color temperature of 2,854° K. at the maximum of 1,000 CMS and then processed in one of the following two Processes A and B.

Process A (process of this invention)

| Processing | Temperature | Time |
|---|---|---|
| Development | 25° C. | 4 min |
| Wash | " | 2 min |
| Dye Bleach | 40° C. | 7-13 min |
| Wash | 25° C. | 1 min |
| Blix | " | 3 min |
| Wash | " | 2 min |

The compositions of the processing solutions used in the above processing were as follows:

| | |
|---|---|
| Developer | |
| Ethylenediaminetetraacetic Acid (di-sodium salt) | 1 g |
| Sodium Sulfite | 60 g |
| Hydroquinone | 10 g |
| Sodium Hydroxide | 5 g |
| Diethylene Glycol | 20 ml |
| 1-Phenyl-3-pyrazolidone | 0.4 g |
| Sodium Carbonate | 20 g |
| Potassium Bromide | 9 g |
| Benzotriazole | 0.1 g |
| Water to make | 1 l |
| Dye Bleach Solution | |
| α,α'-Dipyridyl | 1.6 g |
| Monosodium Phosphate (dihydrate) | 60 g |
| Potassium Persulfate | 40.5 g |
| Water to make | 1 l |
| Blix Solution | (pH 3.0) |
| Ammonium Thiosulfate | 150 ml |
| Sodium Sulfite | 5 g |
| Sodium[Iron(III)-ethylenediamine-tetraacetic acid complex salt] | 40 g |
| Ethylenediaminetetraacetic Acid (disodium salt) | 4 g |
| Water to make | 1 l |

Process B (silver dye bleach process for comparison)

| Processing | Temperature | Time |
|---|---|---|
| Development | 25° C. | 4 min |
| Wash | " | 2 min |
| Dye Bleach | 40° C. | 7-13 min |
| Wash | 25° C. | 1 min. |
| Blix | " | 3 min |
| Wash | " | 3 min |

The compositions of the processing solutions used were as follows:

| | |
|---|---|
| Developer | |
| Same as the developer composition of Process A. | |
| Dye Bleach Solution | |
| Hydrochloric Acid (35% aq. soln.) | 100 ml |
| Phenazine | 18 mg |
| Thiourea | 100 g |
| Water to make | 1 l |
| Blix Solution | |
| Same as that of Process A. | |

The results obtained are shown in Table 1 below.

TABLE 1

| Process | Dye Bleaching Time (min) | Maximum Cyan Density | Minimum Cyan Density | Gamma Value | Sensitivity* |
|---|---|---|---|---|---|
| Process A (invention) | 7 | 2.00 | 0.02 | 1.4 | 1.00 |
| | 10 | 2.00 | 0.01 | 1.6 | 1.14 |
| | 13 | 1.98 | 0.01 | 1.6 | 1.26 |
| Process B (comparison) | 7 | 2.00 | 1.56 | 0.24 | — |
| | 10 | 2.01 | 1.55 | 0.25 | — |
| | 13 | 2.00 | 1.55 | 0.25 | — |

*Relative sensitivity when the sensitivity of the photographic element processed for 7 minutes in Process A was designated as 1.00. In Process B, the sensitivity value could not be calculated since the minimum density was too high.

The conventional silver dye bleach process (Process B) required one equivalent of silver for bleaching the dye and hence when the process was applied to a low-silver light-sensitive material (the mole ratio of silver to dye was ½) used in this example, the bleaching was insufficient. On the other hand, in Process A of this invention, the silver acted catalytically and hence the bleaching was performed sufficiently and cyan positive images having a low minimum density were obtained. Also, by prolonging the time for the dye bleaching, the sensitivity could be increased.

EXAMPLE 2

A photographic element was prepared using the same procedure as described in Example 1 except that a magenta dye (2,380 mg/m$^2$) having the following structure:

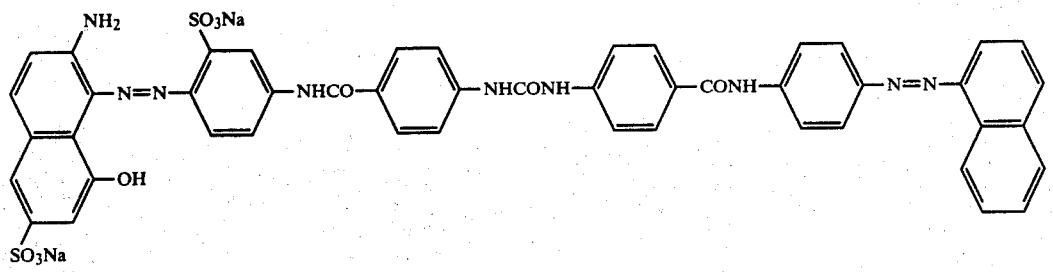

was used in place of the cyan dye. The photographic element was exposed under the same conditions as in Example 1 and processed using Process A as described in Example 1.

Using a dye bleach processing of 15 minutes, magenta positive images having a maximum magenta density of 2.10, a minimum magenta density of 0.08, and a gamma value of 1.2 were obtained.

EXAMPLE 3

A photosensitive element was prepared using the same procedure as described in Example 1 except that a yellow dye (1,580 mg/m$^2$) having the following structure:

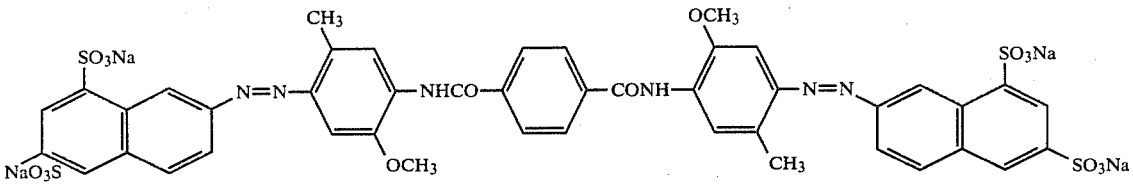

was used in place of the cyan dye. The photographic element was exposed under the same conditions as described in Example 1 and processed using Process A as described in Example 1.

Using a dye bleach processing of 7 minutes, yellow positive images having a maximum yellow density of 2.02, a minimum yellow density of 0.03, and a gamma value of 1.4 were obtained.

EXAMPLE 4

A photographic element prepared as described in Example 1, exposed under the same condition as in Example 1, and processed using processing solutions having the same compositions as described in Process A of Example 1 except that the pH of the dye bleach solution was varied in the range of from 2.0 to 4.7. The results obtained are shown in Table 2 below.

TABLE 2

| pH* | Maximum Cyan Density | Minimum Cyan Density | Gamma Value |
|---|---|---|---|
| 2.0 | 2.00 | 0.12 | 0.96 |
| 2.5 | 2.00 | 0.07 | 1.00 |
| 3.0 | 2.01 | 0.02 | 1.35 |
| 4.0 | 2.00 | 0.01 | 1.35 |
| 4.7 | 2.01 | 0.10 | 1.01 |

*pH of the dye bleach solution.
The dye bleach processing was performed for 7 minutes.

The results show clearly that the optimum pH value in the process of Example 1 is about 3 to 4.

EXAMPLE 5

A photographic element (silver coverage: 50 mg/m$^2$) was prepared by coating a silver chlorobromide emulsion (silver bromide: 70 mol%; mean grain size: 0.2 micron) containing a cyan dye (806 mg/m$^2$) having the same structure as in Example 1 in the same manner as described in Example 1. The photographic element was exposed under the same conditions as in Example 1 and processed using Process A as described in Example 1.

Using a dye bleach processing of 7 minutes, color images having a maximum cyan density of 0.86, a minimum cyan density of 0.01, and a gamma value of 0.92 were obtained.

EXAMPLE 6

A photographic element (silver coverage: 50 mg/m$^2$) was prepared by coating a silver iodobromide emulsion (silver iodide: 4 mol%; mean grain size: 0.7 micron) containing a cyan dye (806 mg/m$^2$) having the same structure as in Example 1 in the same manner as described in Example 1. The photographic element was exposed under the same conditions as in Example 1 and processed as follows:

| Processing Step | Temperature | Time |
|---|---|---|
| Development | 25° C. | 4 min |
| Wash | " | 2 min |
| Fix | " | 5 min |
| Wash | " | 1 min |
| Dye Bleach | 40° C. | 7 min |
| Wash | 25° C. | 1 min |
| Blix | " | 3 min |
| Wash | " | 2 min |

The compositions of the processing solutions used were the same as those in Process A of Example 1 and Kodak F-5 was used as the fixing solution in the above process.

Using the processing, cyan positive images having a maximum cyan density of 0.92, a minimum cyan density of 0.01, and a gamma value of 1.05 were obtained.

EXAMPLE 7

A photographic element was prepared by coating on a cellulose triacetate support having thereon a subbing layer a silver bromide emulsion (mean grain size: 0.7 micron) at a coverage of 100 mg/m$^2$ of silver and coating thereon a gelatin protective layer at a coverage of 1,000 mg/m$^2$ of gelatin.

The photographic element was exposed through an optical wedge using an actinometer to a tungsten lamp of a color temperature of 2,854° K. at the maximum of 300 CMS and then processed as follows:

| Processing Step | Temperature | Time |
|---|---|---|
| Development | 25° C. | 6 min |
| Dyeing | 40° C. | 1 min |
| Wash | 25° C. | 2 min |
| Dye Bleach | 40° C. | 7 min |
| Wash | 25° C. | 2 min |
| Blix | " | 3 min |
| Wash | " | 2 min |

The compositions of the processing solutions used in the above processing were as follows:

| Dyeing Solution | |
|---|---|
| Water | 800 ml |
| Dye* | 10 g |
| $Na_2CO_3$ | 10 g |

-continued

| Dyeing Solution | |
|---|---|
| Water to make | 1 l |

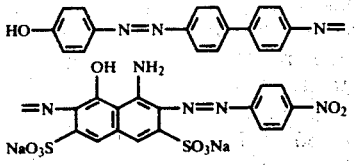

The compositions of the other processing solutions were the same as described for Process A of Example 1.

Using the above processing, cyan positive images having a maximum cyan density of 3.25, a minimum cyan density of 0.10, and a gamma value of 2.08 were obtained.

EXAMPLE 8

The same procedure as in Example 7 was followed except that the following development-dyeing process was substituted for the development process and dyeing process described in Example 7.

| Development Dyeing Processing 40° C. 90 sec | | |
|---|---|---|
| Development Dyeing Solution | | |
| Water | 800 | ml |
| Dye (same structure as in Example 7) | 10 | g |
| Ethylenediaminetetraacetic Acid (disodium salt) | 1 | g |
| Sodium Sulfite | 60 | g |
| Hydroquinone | 6 | g |
| Sodium Hydroxide | 5 | g |
| Diethylene Glycol | 20 | ml |
| 1-Phenyl-3-pyrazolidone | 0.2 | g |
| Potassium Bromide | 1.0 | g |
| Benzotriazole | 0.1 | g |
| Water to make | 1 | l |

Using the above processing, cyan positive images having a maximum cyan density of 3.52, a minimum cyan density of 0.08, and a gamma value of 1.98 were obtained.

While the invention has been described in detail and with reference to specific embodiments thereof, it will be apparent to one skilled in the art that various changes and modifications can be made therein without departing from the spirit and scope thereof.

What is claimed is:

1. A posi-posi process for forming positive color images which comprises processing an image-wise exposed and developed photographic element having silver image-wise distributed therein in the presence of a heterocyclic compound containing at least one nitrogen atom in the heterocyclic nucleus thereof, which exhibits an oxidation reduction potential of Ag(I)/Ag-(II) in the range of about 1.9 volts to about 1.1 volts, a peroxo acid or a salt thereof, and a dye, to oxidatively bleach the dye at a pH of 2 to 7 at the areas where silver is present due to the catalytic effect of said silver on the oxidation of said dye, whereby said positive color images are formed.

2. The process as claimed in claim 1, wherein said complexing agent is a nitrogen-containing heterocyclic compound having a nucleus represented by the general formula (I):

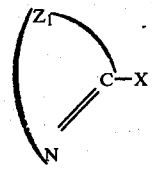

(I)

wherein $Z_1$ represents the atoms necessary for forming a 5-membered or 6-membered heterocyclic ring and X represents —COOM, —OH, —$SO_3M$, —CH=NOH, wherein M represents H, Li, Na, K or $NH_4$, or a heterocyclic ring containing at least one nitrogen atom in the heterocyclic nucleus thereof.

3. The process as claimed in claim 1, wherein said complexing agent is represented by the general formula (II):

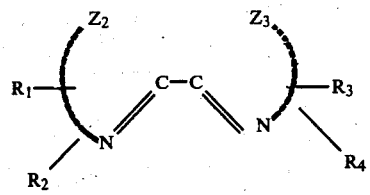

(II)

wherein $Z_2$ and $Z_3$, which may be the same or different, each represents the atoms necessary for forming a 5-membered or 6-membered heterocyclic ring and $R_1$, $R_2$, $R_3$ and $R_4$, which may be the same or different, each represents a hydrogen atom, a lower alkyl group having 1 to 5 carbon atoms, —$SO_3M$ or —COOM, wherein M represents H, Li, Na, K or $NH_4$.

4. The process as claimed in claim 1, wherein said peroxo acid is peroxosulfuric acid, peroxocarbonic acid, peroxodisulfuric acid, peroxoboric acid, peroxophosphoric acid, peroxotungstic acid or peroxotitanic acid.

5. The process as claimed in claim 1, wherein said peroxo acid salt is an alkali metal salt, an alkaline earth metal salt, or an ammonium persulfate.

6. The process as claimed in claim 1, wherein said dye is an azo dye or an anthraquinone dye capable of being oxidatively bleached.

7. The process as claimed in claim 3, wherein said ring formed by $Z_1$ in the general formula (I) is a pyridine ring.

8. The process as claimed in claim 4, wherein said complexing agent represented by the general formula (II) is an $\alpha,\alpha'$-dipyridyl.

9. The process as claimed in claim 1, wherein said complexing agent is a nitrogen-containing heterocyclic compound having a nucleus represented by the general formula (I):

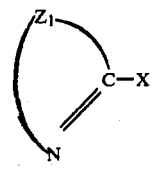

(I)

wherein $Z_1$ represents the atoms necessary for forming a pyridine ring and X represents —COOM, —OH, —$SO_3M$, —CH=NOH, wherein M represents H, Li, Na, K or $NH_4$, or a heterocyclic ring containing at least one nitrogen atom in the heterocyclic nucleus thereof;

said oxidizing agent is a peroxo acid or an alkali metal salt, an alkaline earth metal salt, or an ammonium salt thereof; and said dye is an azo dye or an anthraquinone dye capable of being oxidatively bleached.

10. The process as claimed in claim 1, wherein said complexing agent is represented by the general formula (II):

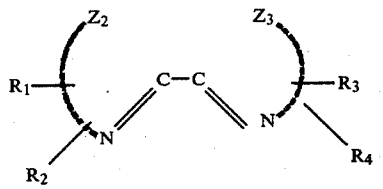

(II)

wherein $Z_2$ and $Z_3$, which may be the same or different, each represents the atoms necessary for forming a pyridine ring and $R_1$, $R_2$, $R_3$ and $R_4$, which may be the same or different, each represents a hydrogen atom, a lower alkyl group having 1 to 5 carbon atoms, —$SO_3M$ or —COOM, wherein M represents H, Li, Na, K or $NH_4$; said oxidizing agent is a peroxo acid or an alkali metal salt, an alkaline earth metal salt, or an ammonium salt thereof; and said dye is an azo dye or an anthraquinone dye capable of being oxidatively bleached.

11. The process of claim 1, wherein said developed photographic element comprises areas of silver and silver halide in correspondence to said image-wise exposure, and wherein said processing simultaneously oxidizes said silver and oxidatively bleaches said dye in areas wherein said silver is present, whereafter said element is fixed or blixed.

12. The process of claim 11, wherein during said oxidative bleach said silver reacts with said complexing agent to yield the monovalent silver complex $AgL_2^+$, which $AgL_2^+$ in turn is reacted to yield the divalent silver complex $AgL_2^{2+}$ which oxidatively bleaches the dye and is converted back to said monovalent silver complex $AgL_2^+$, said silver serving as a catalyst for the reaction, wherein L represents the complexing agent.

* * * * *